US005720397A

United States Patent [19]

Thompson

[11] Patent Number: 5,720,397

[45] Date of Patent: Feb. 24, 1998

[54] REEL RACK

[76] Inventor: Lushen Edward Thompson, P.O. Box 7111, Pine Bluff, Ark. 71611

[21] Appl. No.: 625,148

[22] Filed: Apr. 1, 1996

[51] Int. Cl.[6] ..... A47F 5/00

[52] U.S. Cl. ..... 211/59.4; 206/443

[58] Field of Search ..... 211/59.4, 60.1, 211/70.4, 182, 191; 248/68.1; 206/443

[56] References Cited

U.S. PATENT DOCUMENTS

| | | | |
|---|---|---|---|
| 805,073 | 11/1905 | Kellogg | 211/182 X |
| 1,011,161 | 12/1911 | Comstock | 211/182 X |
| 2,567,522 | 9/1951 | Moen | 211/182 X |
| 2,581,032 | 1/1952 | Landsman | 211/182 X |
| 3,389,882 | 6/1968 | Sohlosser | 211/182 X |
| 3,900,116 | 8/1975 | Gehri | 206/443 |
| 4,190,165 | 2/1980 | Collins | 211/59.4 X |
| 4,431,107 | 2/1984 | Bergstrom et al. | 211/59.4 |
| 4,488,649 | 12/1984 | Mark | 211/182 X |
| 5,102,074 | 4/1992 | Okada | 248/68.1 X |
| 5,257,794 | 11/1993 | Nakamura | 248/68.1 X |

*Primary Examiner*—Robert W. Gibson, Jr.

[57] ABSTRACT

There is disclosed a portable rack made entirely of metal which is uniquely suitable for use in storage and transporting of reels of wire or cable. The rack is designed to accommodate a desired number of cable reels in such a way that fully loaded reels may be stacked atop each other for transporting or storage of such reels, in such a way that the geometric features of the racks accommodate the geometric features of the reels to form a stable stack. The preferred embodiment of the reel rack is sufficiently small in size and weight that it can be manually moved or handled when not in use, yet sufficiently strong to withstand a vertical load of eight tons or more when in use.

9 Claims, 4 Drawing Sheets

REEL RACK

BACKGROUND OF THE INVENTION

There has been a need for a better approach to the handling, storage and transportation of loaded reels of wire and cable within the wire manufacturing industry. This invention addresses that need.

Typically such reels have simply been stacked atop each other on one of the flat cylindrical sides of each reel or stacked on wooden pallets. Due to the shape of the reels they are difficult to move with a lift truck unless placed on a pallet or similar apparatus, and due to their geometric shape it has been difficult to form a stable stack with or without the use of pallets.

Loaded reels typically weigh 1,000 pounds or more, and breakage of wooden pallets has been common, which can lead to damaged products or personal injury to workers. Wood is inherently inconsistent in its strength and it is virtually impossible to eliminate the potential for breakage of wooden pallets by inspection or observation. Glued, mailed or stapled joints of wooden pallets tend to become loose and weak with time and wear.

Wooden pallets also have sharp square corners which cause frequent damage to the cable reels or other objects which they may contact during handling or transportation. Such wooden pallets also have a very short useful life span compared to the almost indefinite life span of the steel reel racks of this invention.

SUMMARY OF THE INVENTION

The reel racks of this invention are made entirely of steel and all joints are welded. There are no screws, bolts or other connectors which may break or loosen with time and wear.

Each rack is specially designed to accommodate a desired number of reels, in such a way that the reels are stable when loaded onto the rack and the loaded racks may be vertically stacked and form a stable and sturdy stack, efficiently utilizing available floor space. The racks are also designed to readily accommodate the forks of a lift truck so that loaded racks may be readily moved about.

An unloaded reel rack designed to accommodate four 1,000 pound cable reels is sufficiently light and compact to be carried or moved by hand, yet is sufficiently strong to withstand normal wear and expected abuse without collapsing or becoming damaged beyond use. It can withstand a vertical load sufficient to be stacked at least three reels high. The members which come in contact with the cable reels are reinforced to reduce the likelihood of collapse under load.

Another advantage of the reel rack of this invention is that all four corners of the reel rack are rounded so that there are no sharp corners which can damage cable reels or other objects which may be bumped or contacted during transportation or handling.

DESCRIPTION OF PREFERRED EMBODIMENT

The disclosed preferred embodiment of the invention is designed for a standard cable reel of 30 inch diameter, and is designed to accommodate four such reels when fully loaded. The invention is comprised of twenty-two component parts, eighteen of which are made from steel pipe and the other four from ¼" steel plate.

Figure 1:
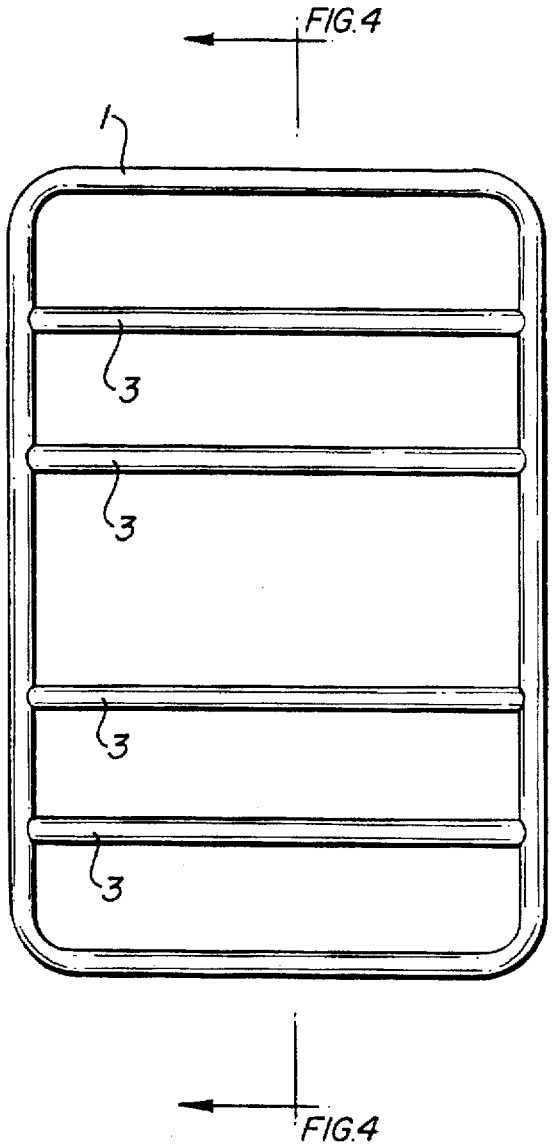
FIG. 1 is a top plan view of a reel rack of this invention.

FIG. 1 is a top plan view of the reel rack of this invention. The outer perimeter is rectangular in shape, slightly rounded at the corners. A 188" length of 1⅝" diameter galvanized pipe is bent with a pipe bending machine to form a rectangle that has inside dimensions of 58 inches by 36 inches and welded together at the ends. This forms the containment members 1 and 2 shown in the drawings. Each rectangular shaped containment member has four horizontal load support members, extending across the narrow side of the rectangle, such as the upper support members 3 of FIG. 1. Each of these support members is made of 1⅝" galvanized pipe 36" in length, and cut with a round at each end to accommodate the rounded surface of the containment member, and welded to the containment member. This forms upper and lower sections identical to the top plan view of FIG. 1.

Figure 2:
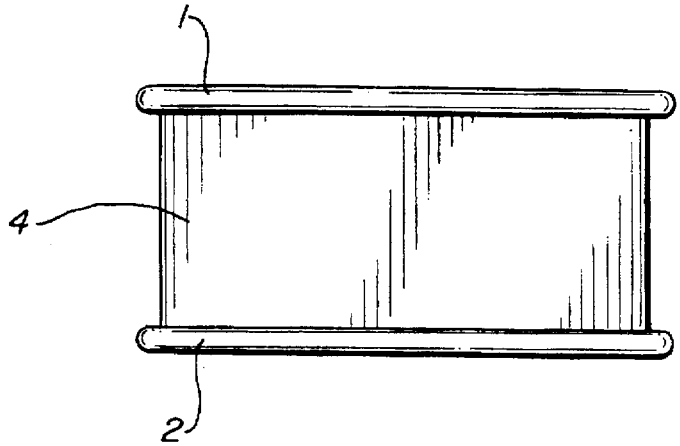
FIG. 2 is an end view.
Figure 3:
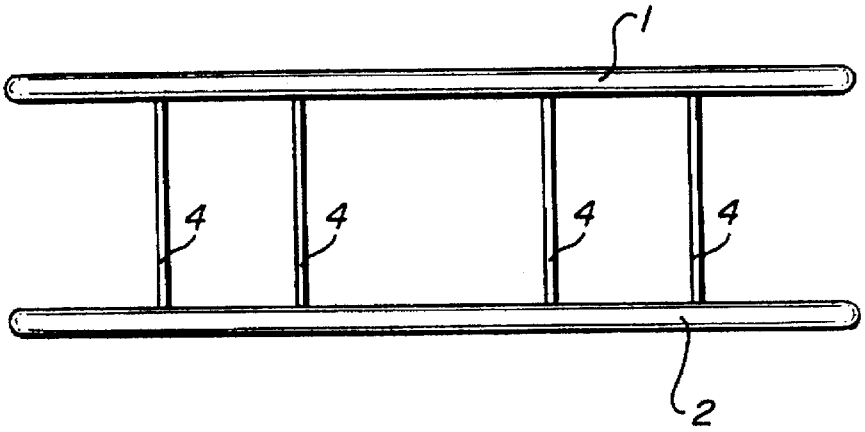
FIG. 3 is a side view.

The upper and lower sections are joined by four load bearing members 4, one of which is shown in the end view of FIG. 2. The side view of FIG. 3 shows the upper containment member 1 and the lower containment member 2 and the four load bearing members 4. The load bearing members 4 are vertically disposed between and welded to upper support members 3 and lower support members 5 shown in FIG. 4.

Figure 4A:
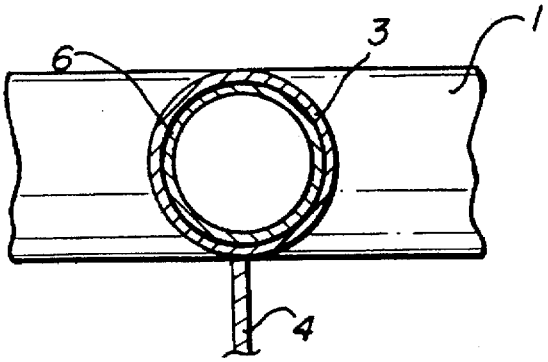
FIG. 4A is a blow-up of the cross section of one of the support members.
Figure 4:
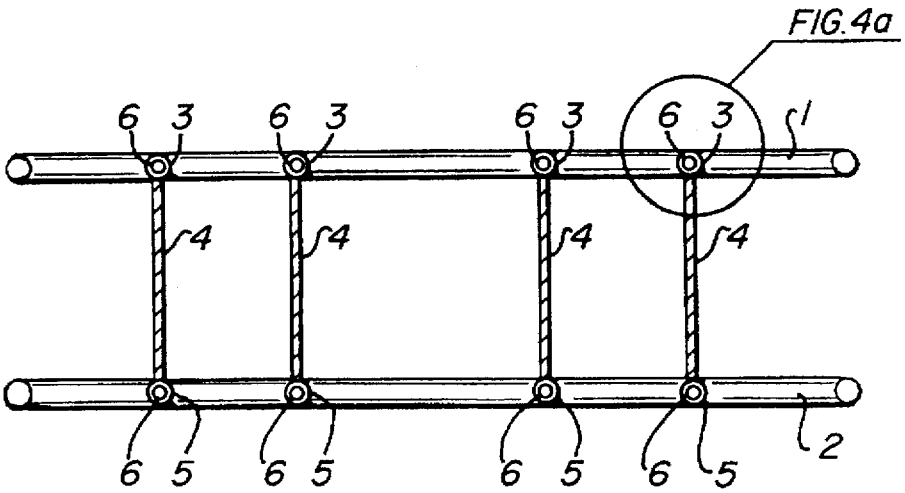
FIG. 4 is a cross section of the side view of FIG. 3.

FIG. 4 is a cross-section view of FIG. 3, which shows the reinforcing members 6 inside both the upper and lower support members 3 and 5. These reinforcing members 6 are formed of 1¼" steel pipe cut 34" in length that slide inside the upper and lower support members 3 and 5. The wall thickness of support members 3 and 5 is 0.17" so that the reinforcing members slide easily into but fit snugly within the support members.

FIG. 4A is a blown up cross section view of a support member with a reinforcing member inside. Early prototypes of the invention without these reinforcing members were found to be structurally inadequate, as the support members would become dented or flattened from the rigors of usage with loaded cable reels. This problem has been eliminated with the insertion of the reinforcing members.

The load bearing members 4 are made of ¼" steel plate and are welded to the upper and lower support members 3 and 5. FIG. 2 illustrates an end view showing upper support member 1 connected to lower support member 2 by load bearing member 4.

Figure 5:
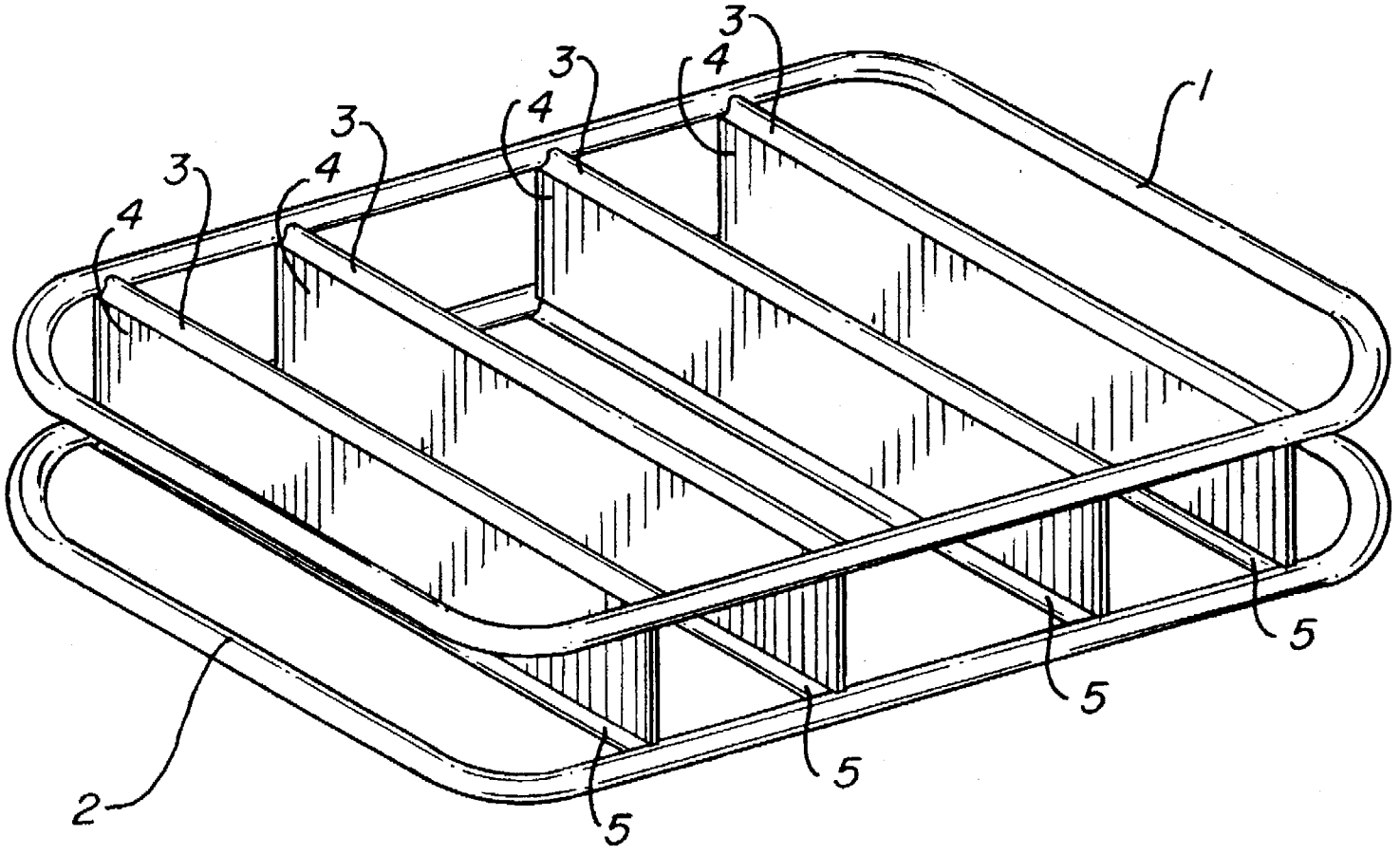
FIG. 5 is a perspective view.

FIG. 5 is a perspective view of the reel rack of this invention. The upper containment member 1 has four support member 3 extending across and connecting its narrow sides, and lower containment member 2 has four support members 5 extending across and connecting its narrow sides. The upper support members 3 and lower support members 5 are connected by four load bearing members 4 to complete the reel rack.

Figure 6:
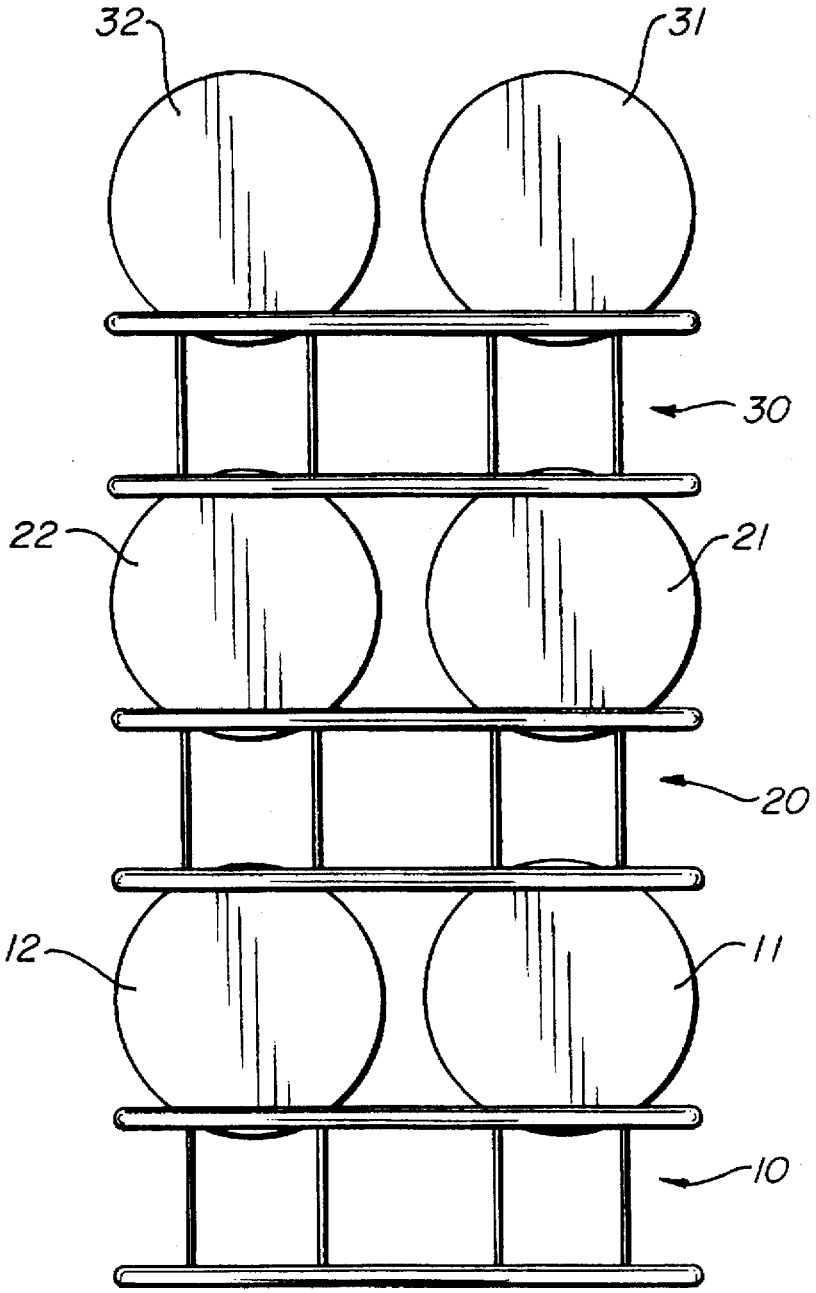
FIG. 6 is a side view of a vertical stack of three reel racks loaded with cable reels.

FIG. 6 illustrates a stack of three reel racks loaded with cable reels. A first reel rack 10 is loaded with cable reels 11 and 12. Actually a third and fourth cable reel, not visible in this end view, will be located directly behind cable reels 11 and 12, as each rack is designed for four reels. A second reel rack 20 sits atop cable reels 11 and 12, and is loaded with cable reels 21 and 22, plus two additional cable reels located directly behind 21 and 22. A reel rack 30 sits atop cable reels 21 and 22, and is loaded with cable reels 31 and 32, plus two additional cable reels not visible in the drawing.

As can be seen from FIG. 6, the spacing of the support members accommodates the outer circumference of the cable reels in such a way that the cable reels sit firmly and securely in place. As each successive reel rack is placed on top of the reels loaded on the rack below, the top portion of the cable reels accommodate the lower section of the reel rack, and a stable vertical stack is formed. In the disclosed embodiment intended for use with 30" cable reels the spacing between each set of support members is approximately 13¼", with the spacing between the inner support members of each set being approximately 17½".

All joints are welded and no screws or fasteners are used. The reel racks thusly made are stable and durable and may be economically produced from readily available materials.

Reel racks intended for use with more than four cable reels and/or for cable reels of a predetermined diameter other than 30" can be made without deviating from the scope and concept of the invention.

I claim:

1. A reel rack comprising a. upper and lower rectangular shaped containment members;

b. at least four upper support members attached to the narrow sides of the upper containment member;

c. at least four lower support members attached to the narrow sides of the lower containment member;

d. at least four load bearing members vertically disposed between and connecting upper and lower support members; and e. a reinforcing member located within each of the upper and lower support members.

2. The reel rack of claim 1 wherein the load bearing members are composed of steel plate.

3. The reel rack of claim 1 wherein the containment members and the upper and lower support members are composed of round steel pipe.

4. The reel rack of claim 1 wherein the support members and the reinforcing members are composed of round steel pipe, and the outside diameter of the reinforcing members is slightly less than the inside diameter of the support members so that the reinforcing members fit snugly within the support members.

5. The reel rack of claim 1 wherein all members are composed of steel and are joined together by means of welded seams.

6. The reel rack of claim 1 wherein the spacing of the support members is designed to accommodate reels of a predetermined diameter.

7. The reel rack of claim 1 wherein the corners of the upper and lower rectangular shaped containment members are rounded.

8. A reel rack comprising:

a. upper and lower containment members composed of steel pipe bent into the form of a rectangle with rounded corners and welded together at the ends;

b. at least four upper support members composed of steel pipe and attached by means of welding to the narrow sides of the upper containment member;

c. at least four lower support members composed of steel pipe and attached by means of welding to the narrow sides of the lower containment member;

d. at lease four load bearing members composed of steel plate and vertically disposed between and connected by means of welding to an upper support member and a lower support member; and e. reinforcing members composed of steel pipe slightly smaller in diameter than the support members and located snugly within the inner circumference of the support members.

9. The reel rack of claim 8 wherein the spacing of the support members is designed to accommodate reels of a predetermined diameter.

* * * * *